US008437626B2

(12) United States Patent
Ding et al.

(10) Patent No.: US 8,437,626 B2
(45) Date of Patent: May 7, 2013

(54) MIXED ENERGY HEATER WITH CONSTANT TEMPERATURE CONTROL

(75) Inventors: Wei Ding, Nanjing (CN); Bu Qiu, Nanjing (CN); Ping Ju, Nanjing (CN); Zejun Jia, Nanjing (CN)

(73) Assignee: A.O. Smith Corporation, Milwaukee, WI (US)

( * ) Notice: Subject to any disclaimer, the term of this patent is extended or adjusted under 35 U.S.C. 154(b) by 694 days.

(21) Appl. No.: 12/573,975

(22) Filed: Oct. 6, 2009

(65) Prior Publication Data

US 2010/0111508 A1 May 6, 2010

(30) Foreign Application Priority Data

Oct. 7, 2008 (CN) ..... 2008 1 0155709

(51) Int. Cl.
*F24C 1/00* (2006.01)

(52) U.S. Cl.
USPC ..... 392/308; 392/307

(58) Field of Classification Search ..... None
See application file for complete search history.

(56) References Cited

U.S. PATENT DOCUMENTS 4,746,495 A 5/1988 Mingaud et al.

FOREIGN PATENT DOCUMENTS

| | | |
|---|---|---|
| CA | 1082759 | 7/1980 |
| CA | 2456926 | 2/2003 |
| CN | 2489262 | 5/2002 |
| CN | 2535718 | 2/2003 |
| CN | 2921682 | 7/2007 |
| CN | 2932221 | 8/2007 |

OTHER PUBLICATIONS

Canadian Patent Office Action for Application No. 2,681,785 dated Jan. 10, 2012 (3 pages).
Canadian Patent Office Action for Application No. 2,681,785 dated Jan. 11, 2013 (2 pages).

*Primary Examiner* — Thor Campbell
(74) *Attorney, Agent, or Firm* — Michael Best & Friedrich LLP

(57) ABSTRACT

A type of mixed energy heater with constant temperature control, which belongs to the field of water heater technology. This water heater includes a gas heating portion, an electric heating portion, and a control circuit. The control circuit includes a power output controller. The electric heating portion is composed of water passage and electric heating device installed in the water passage. The water passages of the gas heating portion and the electric heating portion are connected together in series or in parallel, and the terminal of the passage is equipped with a temperature sensor. The output of the temperature sensor is connected to the signal input of the control circuit.

10 Claims, 6 Drawing Sheets

MIXED ENERGY HEATER WITH CONSTANT TEMPERATURE CONTROL

RELATED APPLICATIONS

This application claims foreign priority under 35 U.S.C. 119 to Chinese patent application no. 200810155709.3, filed on Oct. 7, 2008.

FIELD OF THE INVENTION

The invention relates to a water heater. More particularly, the invention relates to a mixed energy heater with constant temperature control.

BACKGROUND

A gas water heater typically endeavors to supply hot water with a constant temperature. Some influences that impact the temperature of the hot water from traditional gas water heaters include: gas quantity, water flow, and air delivery. During the control of the temperature of the water supply, due to the consideration of safety and environmental protection, the water heater balances the gas quantity and the air delivery (e.g., controlled by a fan) to ensure the complete combustion of the gas. The control of the water temperature becomes a complicated operation that needs to take into integral consideration of multiple factors. As a result, the control may attend to one factor and lose another; therefore, it cannot reach a perfect control effect. In addition, a gas water heater can include the followings concerns.

1. In order to promote safety, when the gas water heater starts, the fan should operate prior to ignition. When the gas water heater stops, the fan should stop after the flameout. Therefore, for frequent use of small amounts of water, a long time to wait for a rising temperature may occur. This wastes water and gas, as well as makes people feel uncomfortable.
2. Upon each start, the gas water heater makes a noise of the fan purging and ignition, which can disturb people.
3. The control actuator (such as a proportional valve) is complicated in its structure, and also needs the help of mechanical action. Therefore, during the action of the actuator, there can be an "overshoot", i.e. the temperature of the water is offset from the control value in transient time. This can make people using the water uncomfortable.

The public specification of Chinese patent application number 02226554.6 provides an adjustable constant temperature gas water heater. This heater is characterized in that: a solenoid valve for each gas nozzle of the main burner and several water temperature controllers of different temperature on the hot water pipe. The user can set the water temperature by the temperature regulator, which controls the opening of solenoid valves in order to obtain water with constant temperature. This technique is not only complicated in temperature control, but the constant temperature control is a step-type. Therefore, the temperature control may not provide accurate control and cannot overcome the above-mentioned defects.

The public specification of Chinese patent application number 200620058136.9 provides a central water heater. The central water heater is characterized in that: electric storage water heater and gas water heater are connected in series. Therefore, the heater has the advantages of both electric storage water heater and gas water heater, not only for fast hot water supply, but also for continuous hot water supply. However, this heater does not concern a constant temperature control.

The public specification of Chinese patent application number 01206912.4 provides a constant temperature gas instant water heater, for which, the electric heating water storage thermostat is installed on one side of constant temperature gas water heater and the water storage tank of the electric heating water storage thermostat is equipped with a multi-hole water inlet pipe. The pipe is connected to the water outlet pipe of the gas heat exchanger by a connector. The connector is installed with a temperature sensor that is connected to an intelligent controller via a conductor. According to the description, there is hot water supply once the water heater is opened, there is cooler water during intermittent use, and the temperature of water keeps constant. But theoretic analysis and practice show the following shortages: 1. the multi-hole water inlet pipe of the electric water heater is complicated in its structure; 2. the electric heating portion adopts water storage type, so that it will still need a certain time to heat the water in practice; 3. the electric heating device works by a switching method; therefore, it has thermal inertia and cannot keep a constant temperature for the water; 4. the water temperature sensor is installed at the water inlet of electric water heater, which can not acquire an accurate temperature at the water outlet and influences the control on water temperature.

SUMMARY

The purpose of at least one embodiment of this invention is that, against the defects or shortages of the above-mentioned existing techniques, it puts forward a mixed energy heater with constant temperature control that combines gas heating and electric heating together. As a result, in addition to overcoming the defects of complicated temperature control, slow response speed, etc. of the gas water heater, the mixed energy heater realizes constant temperature control to output water by the aid of electric heating.

In one embodiment, the invention includes a mixed energy heater with constant temperature control. The mixed energy heater includes a gas heating part, an electric heating part, and a control circuit. The control circuit includes a power output control element. The electric heating portion includes a water passage and electric heating device installed in the water passage. A water passage of the gas heating portion and the electric heating portion are connected (in series or in parallel) to form a flow passage and the terminal water outlet of the flow passage is equipped with a temperature sensor. The output of the temperature sensor is connected to the signal input of the control circuit. The signal input is connected to the controlled terminal of the power output control element via the control circuit. The output of the power output control element is connected to the electric heating device.

During one operation of the mixed energy heater with constant temperature control, the gas heating portion heats the cold water to approach the temperature setting and the electric heating portion provides additional heating to achieve the temperature setting. Compared with gas heating control, the control circuit can carry out faster and more reliable control to the electric heating device. Due to the compensation heating power of the electric heating device, the water is controlled fully in accordance with the feedback of the temperature sensor for outlet water. The temperature control is very sensitive and accurate and can ensure the outlet water with constant temperature. Thus, it can be seen that this invention has combined the gas heating portion and the electric heating part. Due to the power output of the electric heating portion being capable of stepless continuous adjustment and with fast response speed, "overshoot" is eliminated.

Therefore, accurate constant temperature control can be realized. In addition, comparing with the current techniques, this invention has reached the following effects:

1. Compared with the gas heating part, the electric heating portion is simple in structure, no need of complicated starting procedures (such as fan startup, ignition, etc.), shortens the startup time, no need of purging, and can instantly fulfill the usage of small amount of water under the independent running by itself. Therefore, the mixed energy heater of the invention is flexible and convenient for use.

2. The electric heating part, as a compensation to the unstable outlet water temperature of the gas heating part, results from the change of external conditions (such as water pressure, water flow, gas pressure), and only needs small heating power comparing with instant electric water heater.

3. The mixed energy heater of the invention can save energy due to the heater shortening the temperature rise time during startup compared with instantaneous gas water heaters. Also, the heater shows high efficiency during water use for short time because of its fast startup and reaching constant temperature.

4. Based on the original foundation, the mixed energy heater enlarges the effective outlet water volume of the water heater, which can better fulfill the requirement of use.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Embodiment I

Figure 4:
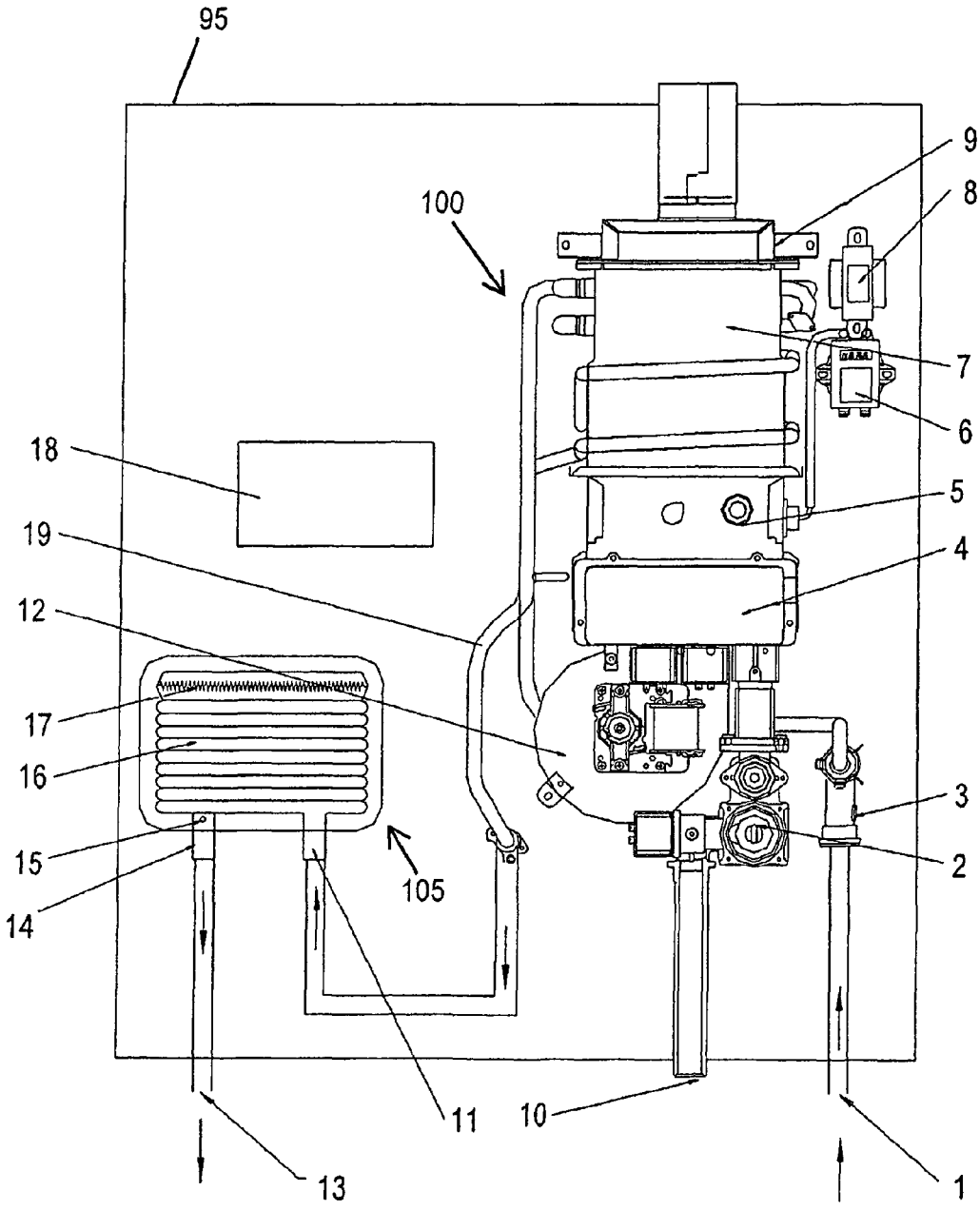
FIG. 4 is a diagram representing embodiment I of the invention.

For this embodiment, please refer to FIG. 4. In the Figure, 1 is a main water inlet, 2 is a valve, 3 is a flow sensor, 4 is a vent pipe, 5 is a combustion chamber, 6 is an igniter, 7 is a heat exchanger, 8 is a transformer, 9 is a smoke collection hood, 10 is an air inlet, 11 is a water inlet connector, 12 is a fan, 13 is a main water outlet, 14 is a water outlet connector, 15 is a temperature sensor, 16 is a water passage, 17 is electrical heating filaments (or electrical heating pipe), 18 is a control circuit, and 19 is a hot water outlet. The mixed energy heater with constant temperature control 95 includes a gas heating portion 100 and an electric heating portion 105 connected via series connection. The gas heating portion 100 is similar to a current gas water heater. The main water inlet 1 from a cold water source is connected to the heat exchanger 7 of the gas heating portion 100 via flow sensor 3. The hot water outlet 19 from the heat exchanger of the gas heating portion 100 is connected to the water inlet connector 11 of the electric heating portion 105 via pipelines. The electric heating portion 105 is composed of bypass water passage 16 in the casing and the electrical heating filaments (or electrical heating pipe) 17 installed in the water passage. The water outlet connector 14 of the electric heating portion 105 is equipped with the temperature sensor 15 and this connector is connected to the external as main water outlet 13 for hot water supply. Furthermore, it is equipped with the temperature sensor 15 for electric heating. In fact, the water passages of the gas heating portion 100 and the electric heating portion 105 constitute a flow passage in series. Cold water flows into the gas heating portion 100 and is heated to approach the temperature setting, then, the water is heated to the temperature setting during while it flows through the electric heating part.

Figure 2:
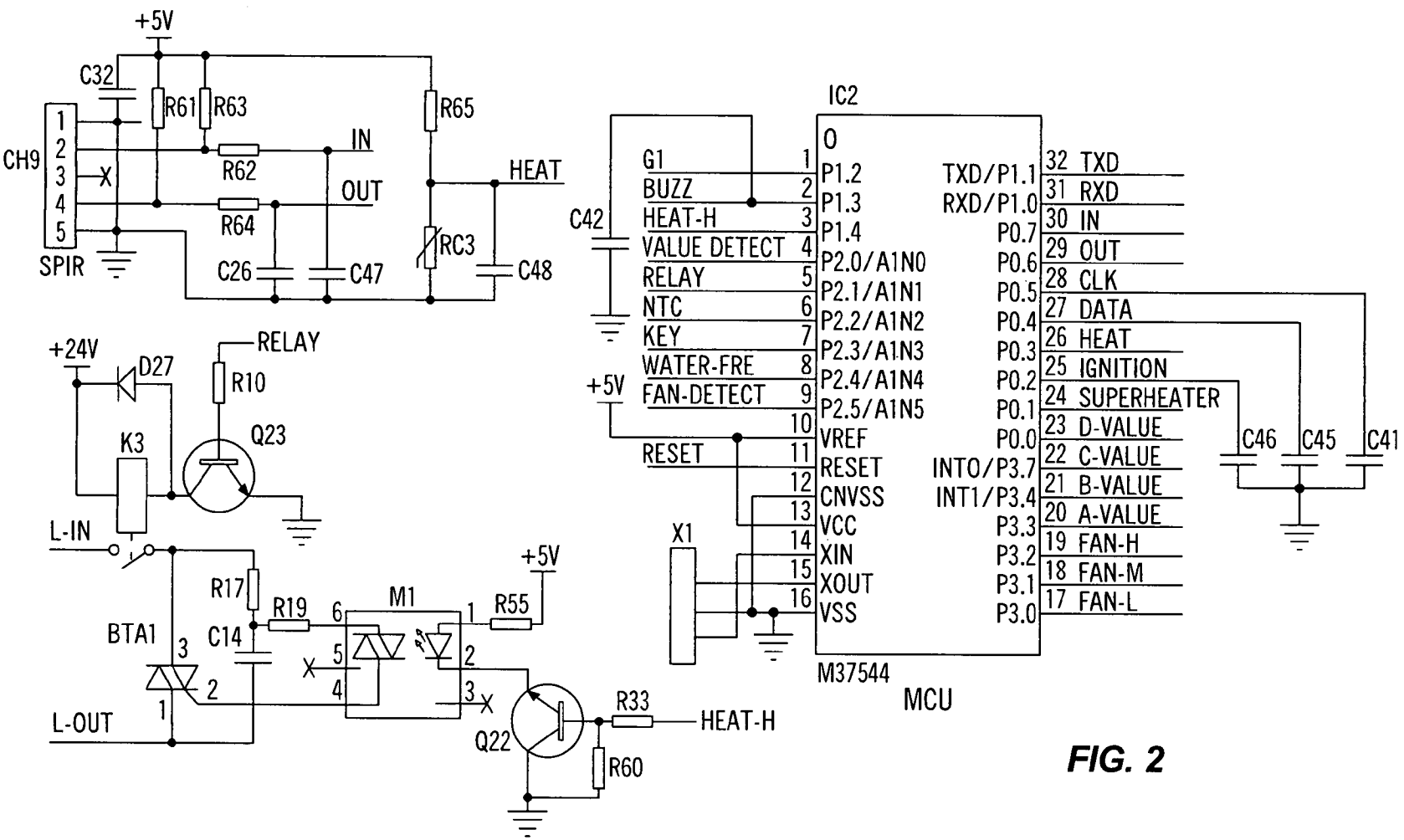
FIG. 2 is an electrical schematic of a portion of embodiment I of the invention.

An electric heating control is added to the control circuit 18 in this embodiment based on the original control circuit of gas water heater that is composed of a power supply circuit, water metering circuit, driving and detecting circuit of fan, control and protection circuit of valve, ignition circuit, etc. This electric heating control includes a microprocessor, temperature detection circuit, and electric heating power control circuit. With reference to FIG. 2, the temperature sensor for outlet water and the original temperature sensor for inlet water go through plug CN9 and are connected to pin 29 & 30 at signal output terminal of microcomputer control unit (MCU) via the OUT and IN output of temperature detection circuit. The temperature detection circuit includes a temperature sensor unit RC3 installed on electrical heating filaments, the output of which will be connected to pin 26 of MCU through HEAT output. The power supply control terminal Pin 5 and the power control terminal Pin 3 of MCU are connected to the relevant controlled terminals of the electric heating power control circuit respectively. The controlled power supply terminal of the power control circuit is connected to relay winding K3 via the first drive triode Q32 and the power supply terminal L-IN is connected to the anode of the controlled silicon BTA1 via the contact of the relay. The controlled power terminal is coupled with the control electrode of the controlled silicon BTA1 via the second drive triode Q22 and the photoelectric coupler M1. The cathode output of the controlled silicon BTA1 is connected to the electrical heating filaments via L-OUT. The electric heating control of this control circuit adopts mixed control of power supply and power, so that it can work safely and reliably.

During operation, the gas heating portion 100 will heat the water to a temperature below the setting for the mixed energy heater 95. Then, the MCU will compare the measured temperature of outlet water with the setting and control the heating power of the electrical heating filaments (or electrical heating pipe) 17 accurately after powered on, so that the difference between the temperature of outlet water and the setting can be compensated by the electric heating portion 105 and the final temperature can keep constant.

Figure 1:
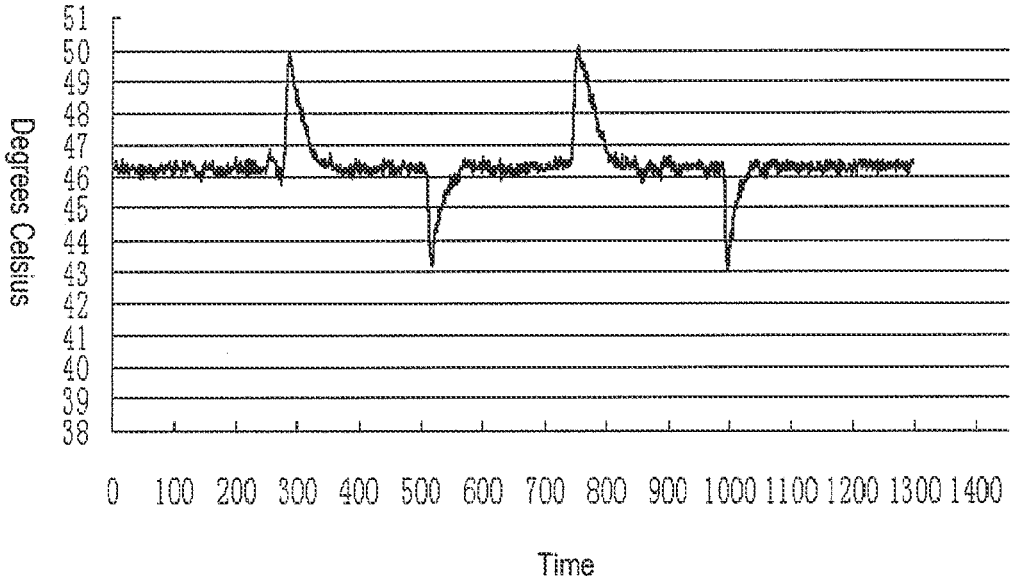
FIG. 1 is a graph representing a hot water outlet temperature curve of a prior art gas water heater controlled by a proportional valve.
Figure 3:
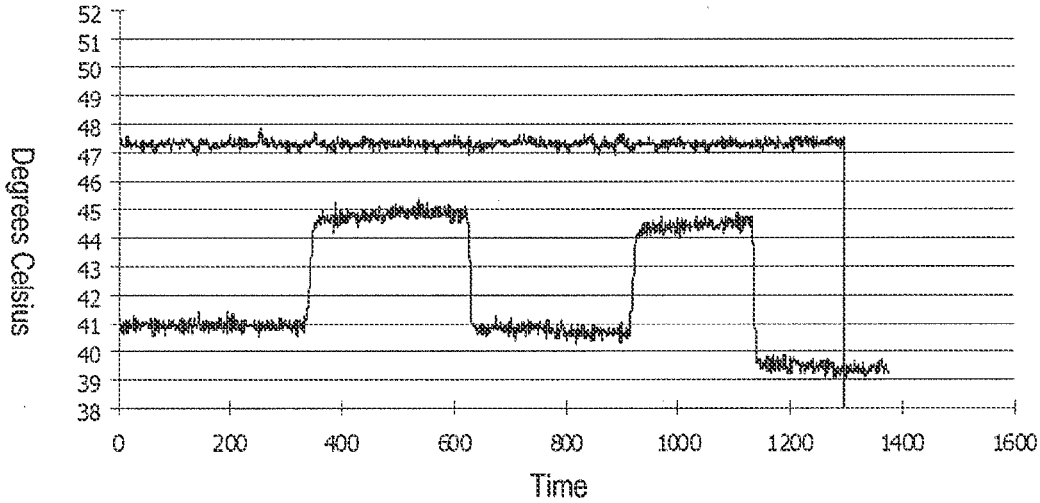
FIG. 3 is a graph representing a hot water outlet temperature curve of embodiment I of the invention.

FIG. 3 is the measured hot water outlet temperature curve. The lower tracing line is for hot water temperature from the gas heating part, which indicates a larger jump fluctuation. The upper tracing line is the temperature of outlet water after the compensation of the electric heating part. Comparing with FIG. 1 of prior systems, it not only eliminates "overshoot", but keeps the temperature fluctuation within one degree Celsius, so that it realizes a perfect control on constant temperature.

One advantage of the embodiment is, when the user only uses small amount of water temporarily, the electric heating portion 105 can provide hot water by itself and the gas heating portion 100 is not necessary to be switched on, so that it is very fast and convenient.

Embodiment II

Figure 5:
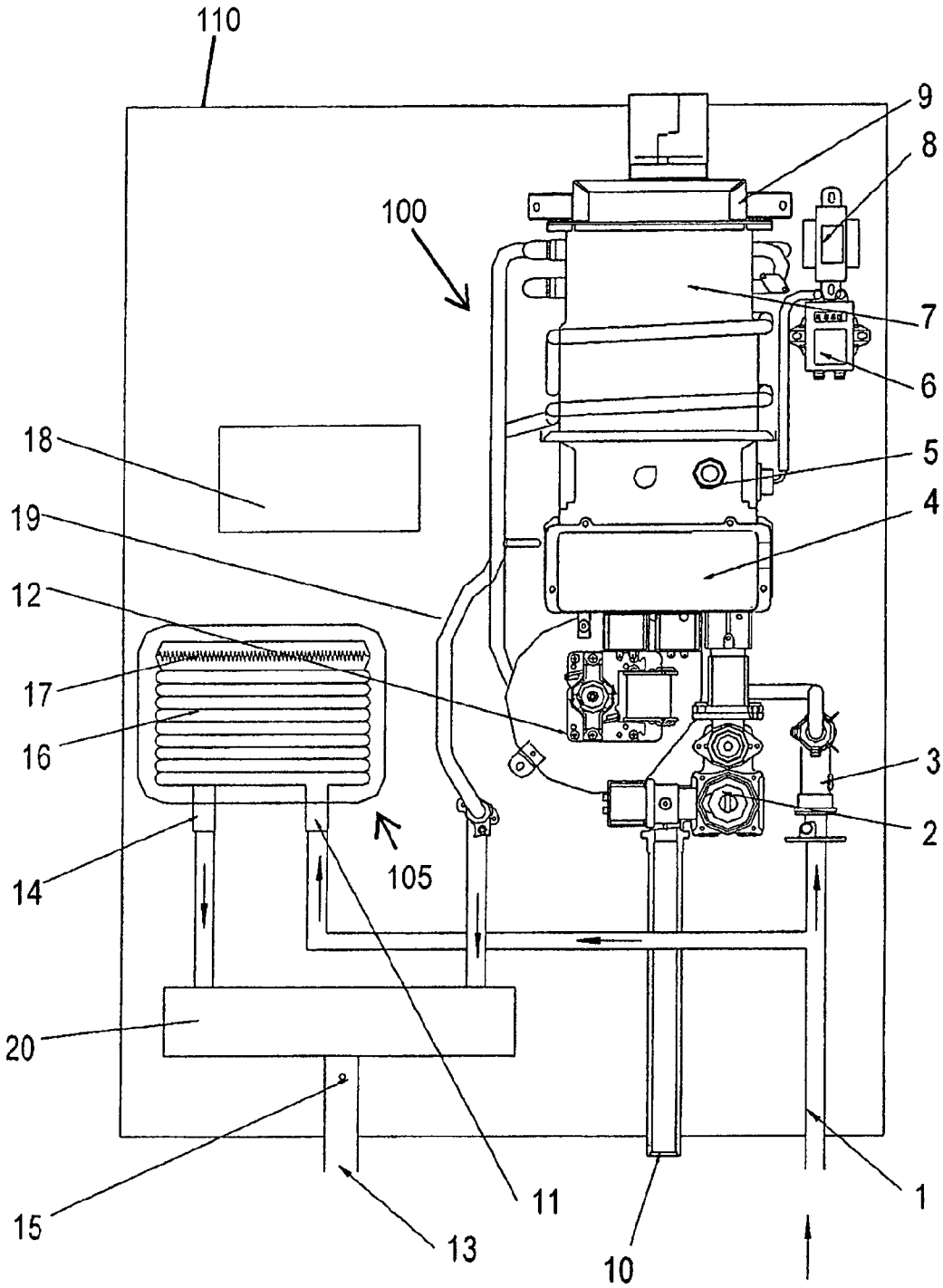
FIG. 5 is a diagram representing embodiment II of the invention.

For this embodiment, please refer to FIG. 5. Its only difference with embodiment I is that the gas heating portion 100 and the electric heating portion 105 in the mixed energy heater 110 with constant temperature control are connected in parallel. In the embodiment, the main water inlet 1 from cold water source is connected to the heat exchanger 7 of the gas heating portion 100 via flow sensor 3. Meanwhile, the main water inlet 1 is also connected to the water inlet connector 11 of the electric heating portion 105 via the pipeline; the hot water outlet 19 from the heat exchanger of the gas heating portion 100 and the water outlet connector 14 of the electric heating portion 105 is connected to a mixing water valve 20 respectively; the mixing water valve works as the main water outlet 13 and it is equipped with a temperature sensor 15.

For operation, please refer to embodiment I.

Embodiment III

Figure 6:
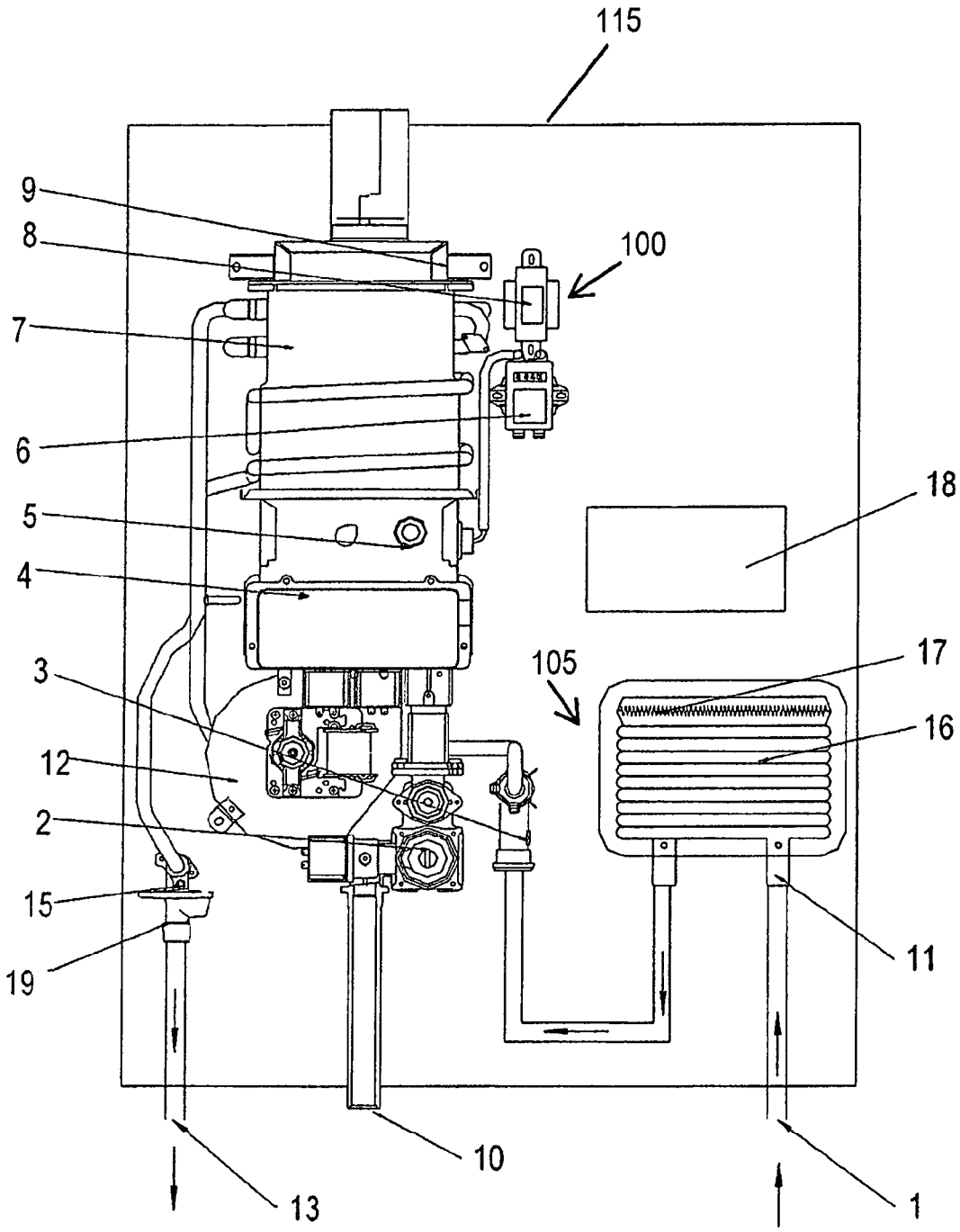
FIG. 6 is a diagram representing embodiment III of the invention.

For this embodiment, please refer to FIG. 6. Comparing with embodiment I, although the gas heating portion 100 and the electric heating portion 105 are connected in series, the main water inlet 1 from the cold water source is connected to the water inlet connector 11 of the electric heating portion 105 via pipeline; the water outlet connector of the electric heating portion 105 is connected to the heat exchanger 7 of the gas heating portion 100 via flow sensor 3; the hot water outlet 19 from the heat exchanger 7 of the gas heating portion 100 is equipped with a temperature sensor 15 and it also works as the main water outlet 13.

During operation, the electric heating portion 105 will provide "compensation" heating at first, then, the gas heating portion will heat the water to the temperature setting. But the power of electric heating portion 105 is still controlled by MCU according to the difference between the temperature of outlet water and the setting, so that it can obtain a same control effect with embodiment I.

Embodiment IV

Figure 7:
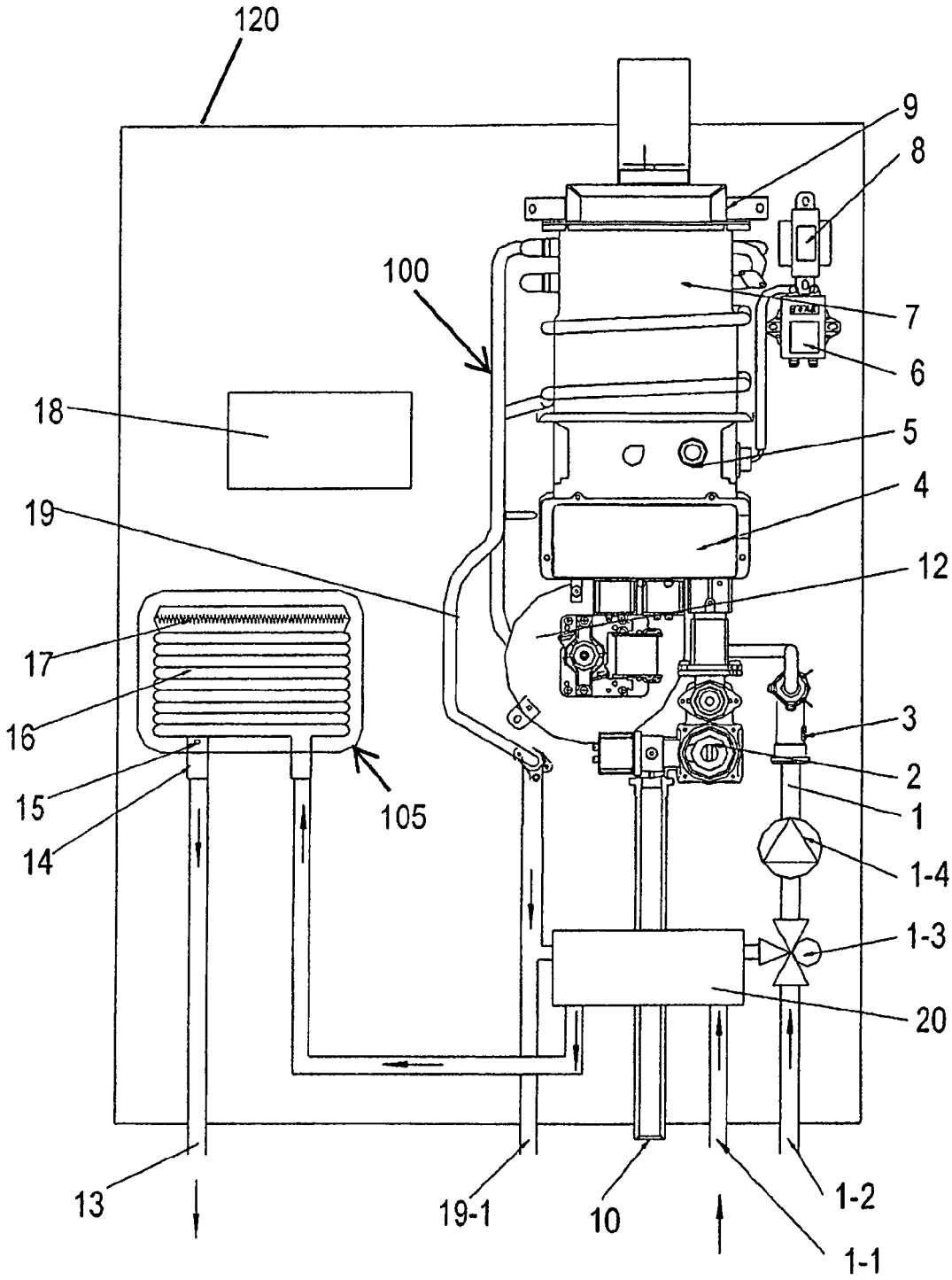
FIG. 7 is a diagram representing embodiment IV of the invention.

For this embodiment, please refer to FIG. 7. It is a type of mixed energy wall-hung hot water & heating apparatus with constant temperature control 120. Its basic structure is similar to embodiment I. The major difference falls on: the heating return water inlet 1-2 is connected to the main water inlet 1 of the gas heating portion 100 and the water outlet 19 of the gas heating portion 100 is connected to external heating pipeline via the heating water outlet connector 19-1, so that the external cyclic heating loop is constituted; meanwhile, the hot water outlet 19 of the gas heating portion 100 is connected to another outlet of the three-way valve 1-3 through the passage in heat exchanger 20, which constitutes the heating loop for internal circulation. The domestic water inlet 1-1 is connected to the water inlet connector 11 of the electric heating portion 105 through the other passage of the heat exchanger 20 and the water outlet connector 14 of the electric heating portion 105 works as the main water outlet 13 for domestic water. In this way, similar to embodiment I, the domestic water is heated by the gas and electric heating parts in series connection. The only difference is there are two times of heat exchange at the gas heating part. Its working principle of constant temperature control is the similar to embodiment I.

Accordingly, the invention provides new and useful mixed energy heater with constant temperature control. Various features and advantages of the invention are set forth in the following claims.

What is claimed is:

1. A mixed energy heater with constant temperature control, the mixed energy heater comprising a gas heating portion, an electric heating portion, a control circuit, and a flow passage, the control circuit including a power output controller, the electric heating portion including a first water passage and an electric heating device coupled to the first water passage, the gas heating portion including a heat exchanger and a second water passage coupled to the first water passage, the flow passage including the first water passage and the second water passage, a temperature sensor coupled to an outlet of the flow passage, the output of the temperature sensor is connected to a signal input of the control circuit, the signal input is connected to the power output controller, the output of the power output controller is connected to the electric heating device, wherein the power output controller includes a microprocessor, and wherein the control circuit includes a temperature detection circuit and an electric heating power control circuit, the temperature sensor is connected to the microprocessor via the temperature detection circuit, a power supply control terminal and a power control terminal of the microprocessor are connected to the controlled power supply terminal and the controlled power terminal of the electric heating power control circuit respectively, wherein an inlet of the gas heating portion is connected to a heating water return via a three-way valve and a circulating water pump, an external heating pipeline is connected to a hot water outlet of the gas heating portion via a heating water outlet connector, another inlet of the three-way valve is connected to the hot water outlet of the gas heating portion through the flow passage of a second heat exchanger, an inlet of the electric heating portion receives water from an inlet of domestic water through the other flow passage of the second heat exchanger, and the main outlet for domestic water receives water from an outlet connector of the electric heating portion.

2. A mixed energy heater with constant temperature control for heating water, the mixed energy heater comprising:

a gas heating portion including
- a combustion chamber,
- a heat exchanger in communication with the combustion chamber, the heat exchanger heating the water with heat emanating from the combustion chamber;

an electric heating portion including
- a water passage for transmitting the water,
- an electrical heating source interconnected with the water passage, the electrical heating portion heating the water with heat emanating from the electrical heating source;

a flow passage via the gas heating portion and the electric heating portion, the flow passage including the water passage of the electric heating portion;

a temperature sensor coupled to the flow passage at a location, the temperature sensor sensing a temperature at the location;

a controller connected to the temperature sensor, the gas heating portion, and the electric heating portion, the controller configured to control the heat emanating from the combustion chamber in a way that causes the temperature of the water in the gas heating portion to approach a first temperature and prevents the temperature of the water in the gas heating portion from reaching a set point temperature for the mixed energy heater, the first temperature being less than the set point temperature, and control the heat emanating from the electrical heating source in a way that causes the temperature of the water exiting the mixed energy heater to substantially equal the set point temperature.

3. The mixed energy heater of claim 2, wherein the gas heating portion and the electrical heating portion are connected in series flow.

4. The mixed energy heater of claim 3, wherein the gas heating portion includes a water inlet and a water outlet, wherein the electric heating portion includes a water inlet and a water outlet, wherein the water inlet for the electric heating portion receives water from the water outlet for the gas heating portion.

5. The mixed energy heater of claim 2, wherein the gas heating portion and the electrical heating portion are connected in parallel flow, and wherein the controller is configured to control the heat emanating from the electrical heating source in a way that causes the temperature of the water in the electric heating portion to exceed the set point temperature.

6. The mixed energy heater of claim 5 wherein the gas heating portion includes a water inlet and a water outlet, wherein the electric heating portion includes a water inlet and a water outlet, wherein the mixed energy heater further comprises a mixing valve having a water inlet and a water outlet, wherein the water inlet for the mixing valve receives water from the water outlet for the gas heating portion and water from the water outlet for the electric heating portion.

7. The mixed energy heater of claim 2, and further comprising a second heat exchanger in communication with the gas heating portion and the electric heating portion, wherein the flow passage includes a heating water passage and a domestic water passage, wherein the second heat exchanger heats water of the domestic water passage with heat emanating from water of the heating water passage, and wherein the gas heating portion includes the heating water passage and the electric heating portion includes the domestic water passage.

8. The mixed energy heater of claim 2, wherein the location of the temperature sensor includes the outlet of the electric heating portion.

9. The mixed energy heater of claim 2, and further comprising a second temperature sensor coupled to the flow passage at a second location, the second temperature sensor sensing a second temperature at the second location, wherein the controller further controls the gas heating portion based on the second temperature and controls the electric heating portion based on the temperature.

10. The mixed energy heater of claim 2, wherein the gas heating portion further includes a second water passage, and the flow passage further includes the second water passage in fluid communication with the first water passage.

* * * * *